United States Patent [19]

Gentile

[11] 4,368,863

[45] Jan. 18, 1983

[54] IRON HOLDER

[76] Inventor: John N. Gentile, Box 377-K Noyack Rd., Sag Harbor, N.Y. 11963

[21] Appl. No.: 174,679

[22] Filed: Aug. 1, 1980

[51] Int. Cl.[3] ..... D06F 79/02

[52] U.S. Cl. ..... 248/117.7; 248/505

[58] Field of Search ..... 248/117.4, 117.6, 117.7, 248/117.2, 117.1, 510, 505; 24/261 R

[56] References Cited

U.S. PATENT DOCUMENTS

| | | | |
|---|---|---|---|
| 837,921 | 12/1906 | Fisher | 248/117.6 |
| 1,429,081 | 9/1922 | Koehler | 248/117.6 |
| 1,498,704 | 6/1924 | Wetter | 248/117.6 |
| 2,474,397 | 6/1949 | Henne | 24/261 R |
| 3,000,511 | 9/1961 | Sconzo | 248/300 X |
| 3,202,389 | 8/1965 | Zoffer | 248/117.4 |
| 3,343,772 | 9/1967 | Howell et al. | 248/313 X |
| 4,183,486 | 1/1980 | Esoldi | 248/DIG. 6 X |

*Primary Examiner*—J. Franklin Foss

*Attorney, Agent, or Firm*—Kenneth J. Stempler

[57] ABSTRACT

An iron holder, preferably in kit form, in which a pair of straps, bendable at their ends, is provided. A plate for holding the iron, which includes means for mounting the plate to the straps, is also included. A spring or spring-like element is mounted on the unit for engaging the iron and retaining it in place on the holder.

9 Claims, 4 Drawing Figures

IRON HOLDER

SUMMARY OF THE INVENTION

This invention relates to holders for steam irons, and more particularly to rests which can be assembled easily and quickly to an ironing board.

Iron holders, or rests, are known in the art, and exemplified by the holders illustrated in U.S. Pat. Nos. 1,498,704; 2,886,614; 3,162,415; 3,176,547; and 3,967,802. All of these are complex, expensive units which are difficult to assemble and use.

In accordance with the present invention, an iron holder is disclosed which is easy to assemble, requiring no screws or special tools. In accordance with a further aspect of this invention, a spring or spring-like element is provided which holds the iron in place on the holder when the iron is not in use. The spring or spring-like element also permits the user to remove the iron from the spring simply by lifting the iron.

In summary, the iron holder comprises a plurality of cross braces or straps which can be bent to mount them to an ironing board. Means are provided for mounting a plate to the straps, preferably without the use of screws and preferably without the need to use tools in the assembly operation.

An elastic element is mounted to the unit adapted to engage the toe or nose of the iron. When the nose of the iron is placed under the elastic unit, it securely retains the iron in place on the holder. To remove the iron, the iron is simply lifted up, elastically extending the element, thus releasing the iron.

For best results, the elastic element is a simple, bendable wire which mounts on the rest and extends forward a distance sufficient for it to capture the nose of the iron. The wire is provided with an extension at the point at which it mounts to the rest. The extension contacts the rest as the wire is lifted by the iron, thus holding the iron in place until sufficient force is applied to cause the wire to bend and release the iron.

Referring now to the drawings in which like numerals refer to like parts:

Figure 1:
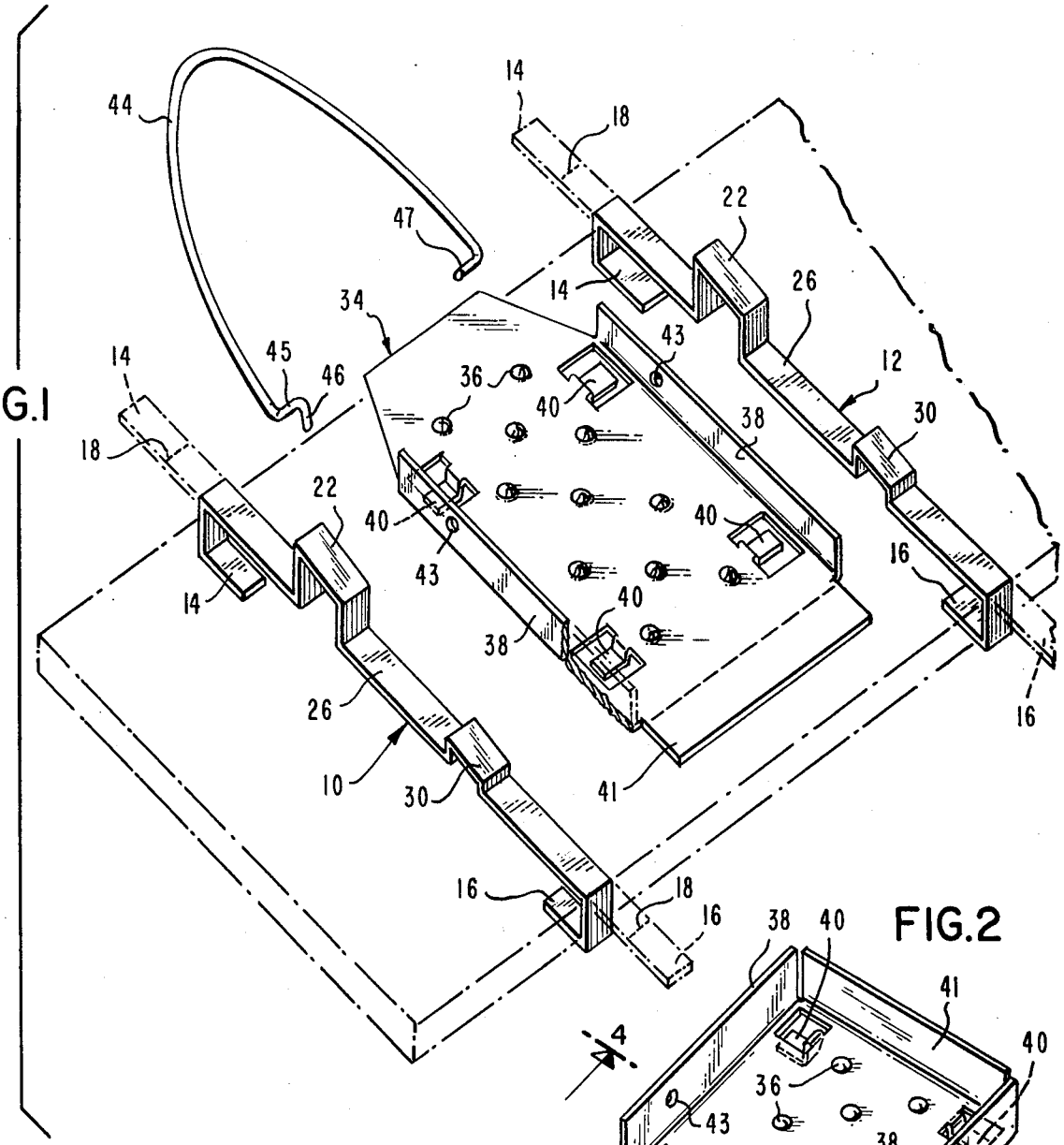
FIG. 1 is an isometric drawing of the various parts of the iron holder.
Figure 2:
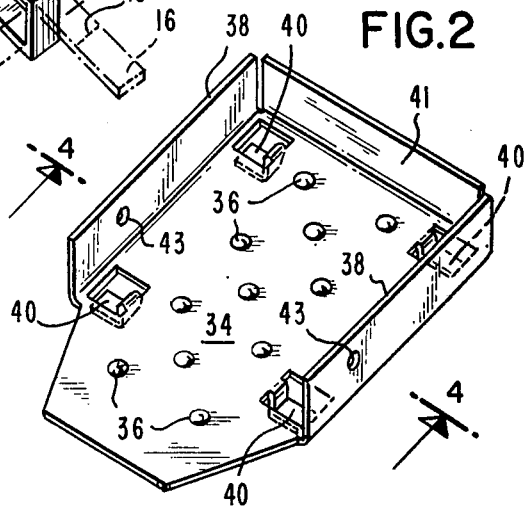
FIG. 2 is an isometric view of the plate.
Figure 4:
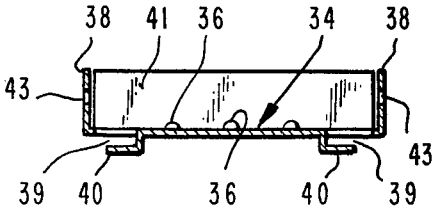

FIG. 4 is a detailed view taken along line 4—4 of FIG. 2. The numerals 10 and 12 denote straps, preferably made of a material having sufficient plasticity to permit the ends 14, 16 to be bent to the shape indicated in FIG. 1. The straps may be made of steel, preferably 18 gauge, which is sufficiently thin to permit the metal to be bent to the shape illustrated. To aid the user in mounting the straps to an ironing board, score lines 18 may be placed on the ends of the straps indicating where, to the average ironing board, the straps should be bent.

Each strap is provided with a raised section 22 separated by a flat bar 26 from a similar raised section 30. The upper surfaces of the raised sections are inclined at an angle, preferably about 25°, for reasons described below.

Plate 34 serves as a rest for the iron 37. The plate is made sufficiently long and wide to support the bulk of the average steam iron, but short enough in its length to allow at least about 1 inch, and preferably 1.75 inches of the nose of the iron to extend past the end of the plate.

As illustrated, the plate 34 is provided with a plurality of raised dimples 36 which tend to prevent undue heating of the plate when a hot iron is allowed to rest thereon. The dimples raise the iron sufficiently to permit cooling air to circulate, thus protecting the plate and the ironing board from excessive heat. Yet the dimples permit the iron to stay close enough to the surface of the plate to retain some heat, thus helping to conserve energy by reducing heat transfer to the atmosphere.

Plate 34 has a pair of spaced side walls 38 which extend most of the length of the plate. Tabs 40 are formed in a punching operation and are bent downwardly, as illustrated, leaving a space 39 between each tab in the bottom of side walls 38.

The side walls are provided with openings 43 for receiving the inwardly bent ends of U-shaped wire 44. As illustrated, end 45 is bent inwardly and then downwardly to form an extension 46. The extension is preferably at an angle of about 15° with respect to the plane of wire 44 for purposes which will be explained below. The other end of the wire, denoted by the numeral 47, is simply bent inwardly, even with and facing the inward bend of end 45.

The plate is also provided with a heel portion 41 which is bent upwardly to the position shown in FIG. 2. If desired, the area of the plate adjacent the heel can be surfaced with a heat resisting material, such as an insulating plastic (not shown) to help increase the life of the plate.

If desired, the metal wire may be made of a tightly coiled metal, but the wire described above is preferred.

To assemble the unit, the straps are placed preferably at the heel of the ironing board, the long axes of the strap straddling the width of the board. The ends of the strap are then bent, as illustrated, to firmly mount the straps to the board. The straps are then moved towards each other until the projections 22 and 30 slip over the tabs 40 and under the side walls 38. At this point, the ends of the straps can be bent under to the full line position illustrated in FIG. 1, friction retaining the straps in place. If desired, screws with a wing-type head (not shown) may be provided at the ends of the straps to more firmly anchor the straps to the board.

Figure 3:
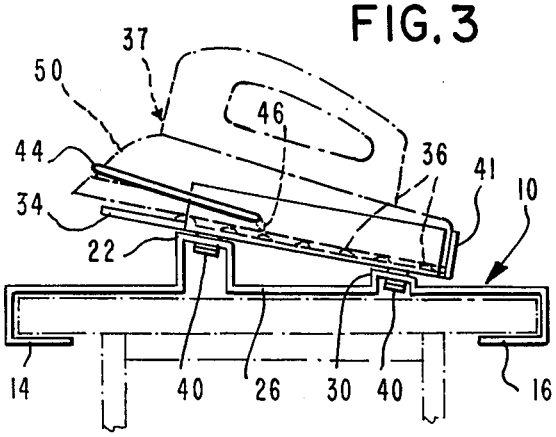
FIG. 3 is a side view of the assembled iron holder, iron in place.

As illustrated in FIG. 3, the plate 34, when mounted to the straps, will assume the angle of the projections on the strap. Placing the plate on an angle, as illustrated, provides for a rather substantial air space between the board and the plate, thus preventing steam and excess heat from reaching the board and destroying its surface. For best results, dimples 36 are formed on the surface of the plate 34 so that the iron, when in place on the plate, will be slightly spaced therefrom. Air will be able to circulate in the space between the plate and the iron, providing some cooling effects. Yet the space is small enough to aid in retaining the water in the iron at or close to its steam temperature, reducing the energy needed to keep the water hot.

When the unit is assembled on the ironing board, the wire rests on the surface of the plate. The iron, in use, when placed on the plate, will also rest on the wire. Thus, the wire does not interfere with ordinary use of the unit as an iron rest.

When the iron is to be stored or left in the rest for an extended period of time, the wire is engaged to retain and firmly hold the iron in place on the rest, thus protecting against the more typical type of household accident, namely accidentally knocking a hot iron off the ironing board.

To engage the wire, the nose 50 of the iron is angled downwardly and slipped into the space between the end of the plate 34 and the tip of the wire 44. The nose is then lifted slightly, causing the wire 44 to rotate upwardly until extension 46 engages the surface of plate 34, thus preventing further upward rotation of the wire. Continued upward pressure on the wire causes it to bend. The return force thus created is akin to the return force of a spring. The return force acts on the nose of the iron and, with the upraised heel 41, provides a firm anchor for the iron in the holder.

To remove the iron, the user lifts it, heel portion first, until the wire disengages the nose. The wire then returns to its rest position on the plate 34 and both the rest and the iron are ready for use.

The parts of the iron holder described above are best provided in kit form for assembly by the ultimate user. With the parts described above, no special tools are needed, nor are screws or other fastening elements necessary.

Many modifications will occur to those skilled in the art. It is intended to cover all such modifications which fall within the scope of the invention as defined in the claims appended hereto.

What I claim is:

1. An iron holder kit comprising:

a pair of straps having ends which can be bent to engage an ironing board, each of said straps having one or more raised portions thereon the surfaces of which are inclined with respect to the longitudinal axis of the strap;

a plate having spaced-apart side walls and a plurality of tabs below and spaced from the lower edge of said side walls, said straps adapted to fit in the space between the tabs and the lower edge of the side walls, said plate having a raised heel portion;

an elastic U-shaped element one end of which is bent inwardly, the other end of which is bent inwardly and downwardly forming a projection;

means on said plate for receiving the ends of said elements.

2. A kit according to claim 1 wherein the surface of said raised portions forms an angle of about 25° with respect to the longitudinal axis of the strap.

3. The kit according to claim 1 wherein said U-shaped element is a wire.

4. The kit according to claim 1 wherein said projection is at an angle of about 15° with respect to the plane of the U-shaped element.

5. The kit according to claim 1 wherein said plate is provided with raised dimples on its surface.

6. An iron holder comprising a pair of straps having one or more raised portions the surfaces of which are inclined at an angle with respect to the longitudinal axis of said straps, a plate having side walls and tabs below said side walls, the raised portions of said straps being located between the tabs and the side walls to mount the plate to the straps, a U-shaped elastic element mounted on said plate and adapted to normally rest thereon, one end of said U-shaped element having a projection thereon for engaging the surface of the plate as the element is lifted.

7. An iron holder according to claim 6 wherein each of said side walls has an opening therein for respectively accepting the ends of the U-shaped element.

8. The iron holder according to claim 6 wherein said U-shaped element is a wire.

9. The iron holder according to claim 8 wherein said projection is at an angle of about 15° with respect to the plane of the wire and wherein said wire normally rests on the plate when the iron is in use, the nose of the iron fitting between the forwardmost portion of the wire in the end of the plate when the iron is to be secured on the iron holder, the projection preventing upward movement beyond a selected amount when the iron is inserted to create a return force to hold the iron in place on the rest, the projection permitting removal of the iron when the return force is exceeded.

* * * * *